United States Patent [19]

Ribaldo

[11] Patent Number: 4,951,562

[45] Date of Patent: Aug. 28, 1990

[54] STRAPPING MACHINE FOR COMPRESSIBLE LOADS

[75] Inventor: David A. Ribaldo, Deerfield, Ill.

[73] Assignee: Signode Corporation, Glenview, Ill.

[21] Appl. No.: 324,200

[22] Filed: Mar. 16, 1989

[51] Int. Cl.[5] ..... B65B 13/30; B30B 1/32

[52] U.S. Cl. ..... 100/8; 100/7; 100/25

[58] Field of Search ..... 100/3, 7, 25, 226, 229 R, 100/8

[56] References Cited

U.S. PATENT DOCUMENTS

| | | | |
|---|---|---|---|
| 1,352,345 | 7/1920 | Becker | 100/3 U X |
| 2,477,872 | 4/1961 | Allfree | 100/3 U X |
| 3,150,586 | 9/1964 | Snider | 100/25 |
| 3,590,731 | 7/1971 | Nichols | 100/7 |
| 3,687,008 | 8/1972 | Lougnran | 100/226 X |
| 3,728,959 | 4/1973 | Fredrickson | 100/3 X |
| 3,824,758 | 7/1974 | Hart et al. | 100/7 X |
| 4,473,005 | 9/1984 | Pasic | 100/7 |

*Primary Examiner*—Frankie L. Stinson

*Attorney, Agent, or Firm*—Thomas W. Buckman; Donald J. Breh

[57] ABSTRACT

A strapping machine arranged to compress a load along a vertical axis, as well as along a longitudinal, horizontal axis, and to confine the load along a transverse, horizontal axis, before strapping the load. A platen is arranged for vertical movement toward and away from a roller table. Load-end formers are arranged, in pairs for relative movement toward and away from each other along a longitudinal, horizontal axis, and for relative movement along the platen, in engagement with the platen at least after the platen has been lowered partially. Load-confining doors are pivotable between closed positions, in which such doors confine opposite sides of the loads, along a transverse, horizontal axis, and opened positions. Strapping heads and coacting strap chutes are carried by the platen.

21 Claims, 8 Drawing Sheets

FIG. 8
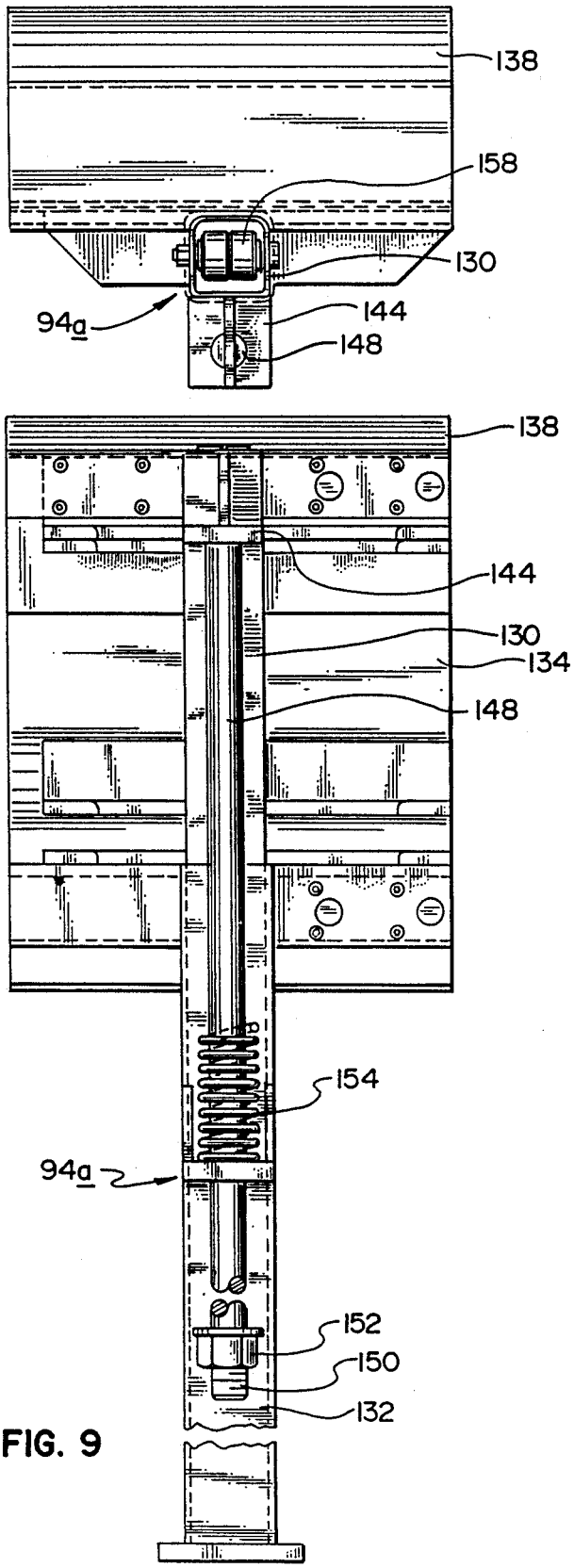
FIG. 9
FIG. 10
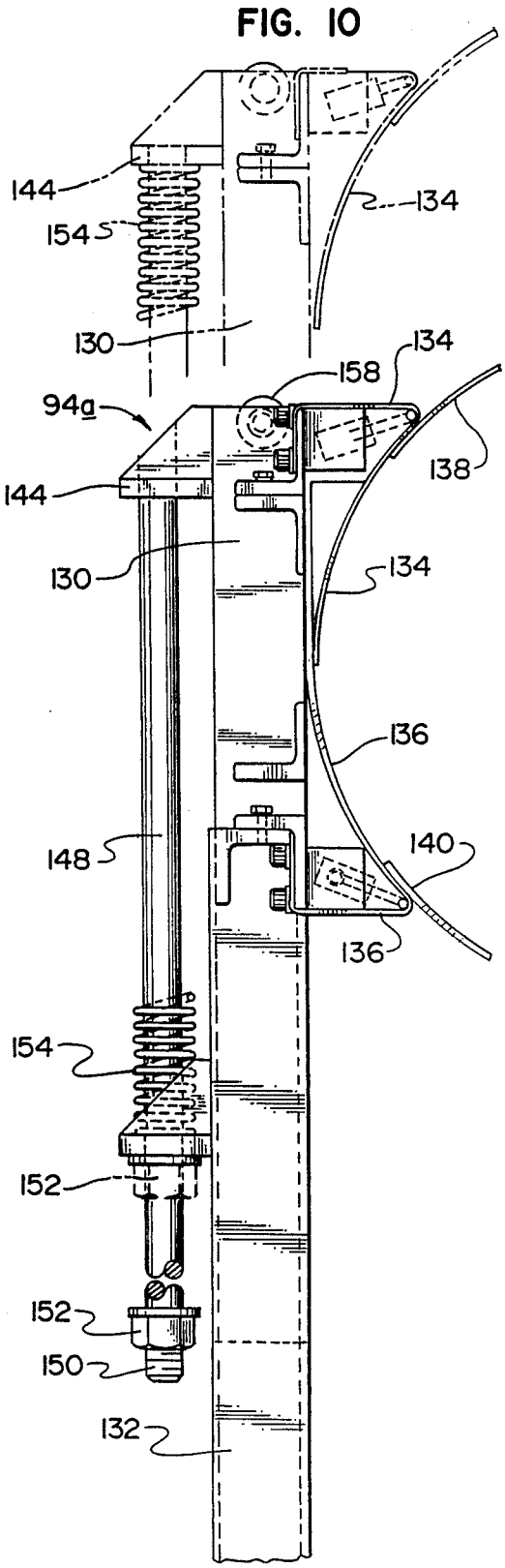

STRAPPING MACHINE FOR COMPRESSIBLE LOADS

TECHNICAL FIELD OF THE INVENTION

This invention pertains to a strapping machine arranged to compress a load before strapping the load, particularly but not exclusively a load compressible along orthogonal axes, as exemplified by but not limited to several bags containing compressible batts of fiberglass insulation or other insulation.

BACKGROUND OF THE INVENTION

Various strapping and other packaging machines are known which compress a load along a single axis or along orthogonal axes, usually a vertical axis and a horizontal axis, before strapping or otherwise packaging the load.

Such a packaging machine, which is described for packaging a group of fibrous mats in a paper sheet, is exemplified in Brown U.S. Pat. No. 2,765,838. The machine disclosed in the Brown patent has a compressing ram, which operates along a vertical axis, two sealing plates, which operate along longitudinal, horizontal axes, and plural crossheads, which operate along transverse, horizontal axes.

A machine for packaging collapsed cartons by compressing such cartons along a vertical axis and strapping them with steel straps is disclosed in Wilson et al. U.S. Pat. No. 2,947,125. A machine for compressing a stack of paper bags along a vertical axis and for wrapping the stack with a paper sheet is disclosed in Lowe et al. U.S. Pat. No. 3,030,750.

A variety of other machines for compressing compressible bales, compressible batts, or similar loads and for strapping or otherwise packaging such loads are disclosed in Merkel et al. U.S. Pat. No. 3,475,879, Hullhorst et al. U.S. Pat. No. 3,499,261, Fox U.S. Pat. No. 3,585,925, Spaulding U.S. Pat. No. 3,977,155, Wistinghausen et al. U.S. Pat. No. 4,099,363, McCormick et al. U.S. Pat. No. 4,343,131, and Smith, Jr., U.S. Pat. No. 4,360,977. See, also, Pasic U.S. Pat. No. 3,735,555.

Although some of these machines and other known machines for similar purposes may be generally satisfactory to their users, there has been a need, to which this invention is addressed, for a strapping machine having improved features by which it is possible to compress a load not only along a vertical axis but also along a longitudinal, horizontal axis, and also to confine the load along a transverse, horizontal axis while the load is compressed, before strapping the load.

SUMMARY OF THE INVENTION

This invention provides a novel combination in a strapping machine arranged to compress a compressible load, as exemplified by but not limited to several bags containing compressible batts of fiberglass insulation or other insulation, before strapping the load with one or more straps.

The strapping machine is similar to known machines in that the strapping machine comprises a frame, a table supported by the frame, preferably a table comprising a plurality of parallel rollers which may be motor-driven, and which are arranged to convey such a load onto and from the table, and a platen mounted to the frame, above the table, for vertical movement of the platen toward and away from the table, between an upper limit and a lower limit. Hydraulically actuated or other means are provided, which are actuatable selectively for elevating the platen to the upper limit or for lowering the platen toward the lower limit.

According to a principal feature contemplated by this invention, one or more pairs of load-end formers are mounted between the table and platen, in engagement with the platen at least after the platen has been lowered partially, and are arranged for relative movement between the load-end formers and the platen and for relative movement of the load-end formers of each pair toward and away from each other, at any elevation of the platen between the upper and lower limits, even with the load-end formers of each pair in engagement with the platen. Such an arrangement wherein the load-end formers are in engagement with the platen is a unique feature provided by this invention.

Preferably, each load-end former of each pair comprises upper and lower portions arranged in a telescoping arrangement or otherwise for relative movement along a vertical axis, between an extended conditon and a shortened condition. The upper portion of each load-end former of each pair is in engagement with the platen at least after the platen has been lowered partially. Spring-loaded or other means are provided for biasing the upper and lower portions of such load-end former toward the extended condition. Also, the platen is arranged to impart relative movement of the upper and lower portions of each load-end former toward the shortened condition, as the platen is lowered with the load-end formers of each pair in engagement with the platen. Thus, each load-end former has an adjustable height, which is adjusted automatically upon vertical movement of the platen toward or away from the table, as another unique feature provided by this invention. Preferably, as well, the upper end of each load-end means is provided with rollable means facilitating relative movement between such load-end former and the platen upon relative movement of the load-end formers of each pair toward or away from each other, with the load-end formers of each pair in engagement with the platen.

Moreover, hydraulically actuated or other means are provided, which are actuatable selectively for imparting relative movement of the load-end formers of each pair toward each other, at any elevation of the platen between the upper and lower limits, or for imparting relative movement of the load-end formers of each pair away from each other, at any elevation of the platen between the upper and lower limits. Therefore, if a compressible load is conveyed or otherwise placed onto the table, below the platen, between the load-end formers of each pair, the load can be endwise compressed along a longitudinal, horizontal axis, between the load-end formers of each pair, while the load is confined between the platen and the table. Moreover, the platen can be also used to compress the load along a vertical axis, between the platen and the table.

Preferably, as an important feature provided by this invention, a pair of load-confining doors are provided. Each load-confining door is mounted to the frame for selective movement between a closed position and an opened position. In the closed position, each load-confining door is disposed so as to confine one side of such a load being compressed between the load-end formers of each pair. In the opended position, each load-confining door is removed so as to permit such a load to be placed onto or displaced from the table.

Preferably, each load-confining door is mounted pivotally to the frame at one edge, namely the edge constituting its lower edge when such load-confining door is in its closed position. Hydraulically actuated or other means may be then provided, which are actuatable selectively for pivoting each load-confining door to its closed position or for pivoting such load-confining door to its opened position.

Preferably, as another important feature contemplated by this invention and applicable when plural pairs of load-end formers are provided as mentioned above, one or more strapping heads and one or more strap chutes are carried by the platen. If one strapping head and one strap chute are carried by the platen, the strapping head coacts with the strap chute. If more than one strapping head and more than one strap chute are carried by the platen, each strapping head coacts with a respective one of the strap chutes.

Each strapping head is carried by the platen, above a load-compressing plane defined by the platen, and is arranged to feed a strap, tension the strap, sever the strap, and join the strap, so as to from a tensioned loop. It does not matter whether the strap, which usually is severed from a coil of strapping, is severed before or after the strap is joined.

Preferably, the strap is a polyester strap, e.g., a poly(ethylene terephthalate) strap, or a polypropylene strap, either type being joinable by friction welding, although a steel strap, which is joined by a metal seal or by a sealless (notched) connection, may be alternatively used. The strapping heads may be accordingly selected from known types of strapping heads.

Each strap chute is arranged to guide a strap being fed by the strapping head coacting with such strap chute and to release the strap when the strap is tensioned by the same strapping head. Each strap chute is aligned with a strap-handling zone defined between two adjacent pairs of the load-end formers.

Each strap chute includes two upper sections, two vertical sections, and a lower section. The upper sections are disposed above the load-compressing plane noted above and are spaced from each other so as to accommodate the strapping head coacting with such strap chute and being disposed between the upper sections. Each vertical section communicates at its upper end with a respective one of the upper sections, passes through a load-supporting plane, as defined by the table, and is adjacent to a respective end of the table. The lower section is disposed below the load-supporting plane, at any elevation of the platen between the upper and lower limits, and communicates at each of its opposite ends with the lower end of a respective one of the vertical sections.

The foregoing features may be advantageously combined in a strapping machine embodying the principal feature noted above. Consequently, the strapping machine is useful to strap a load compressible along orthogonal axes, as exemplified by but not limited to several bags containing compressible batts of fiberglass insulation. If the foregoing features are combined in such a machine, the machine may be advantageously employed to compress such a load not only along a vertical axis but also along a longitudinal, horizontal axis, and also to confine the load along a transverse, horizontal axis while the load is compressed, whereupon the machine may be then used to strap the compressed load with one strap or with a plurality of parallel straps. Each strap passes through a strap-handling zone defined between two adjacent pairs of the load-end formers as such strap is tensioned by the strapping head handling such strap.

These and other objects, features, and advantages of this invention are evident from the following description of a preferred embodiment of this invention with reference to the accompanying drawings.

BRIEF DESCRIPTION OF THE DRAWINGS

FIG. 8 is a greatly enlarged, fragmentary, top plan view of a load-end former, of which the strapping machine comprises plural pairs.

FIG. 9 is a back elevational view of the load-end former shown in FIG. 8.

FIG. 10 is a side elevational view of the load-end former shown in FIGS. 8 and 9. Certain elements are shown in an extended condition, in phantom lines, and in a contracted condition, in full lines.

DETAILED DESCRIPTION OF PREFERRED EMBODIMENT

Figure 1:
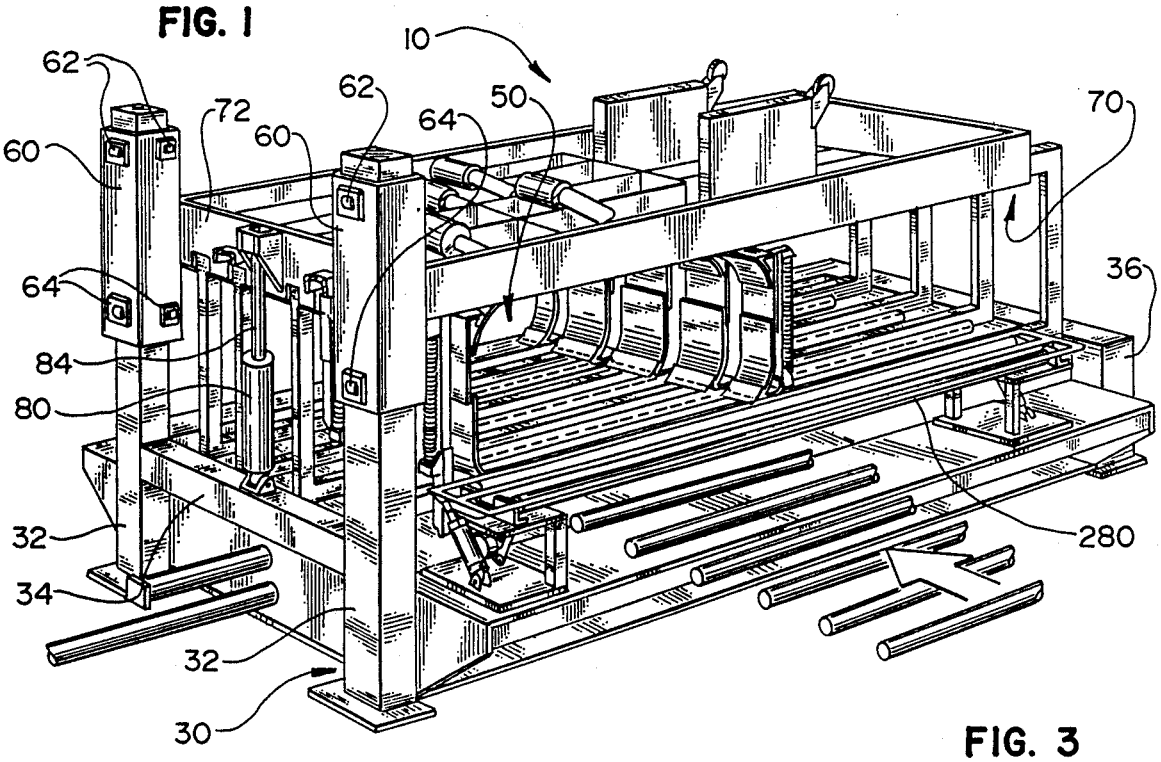
FIG. 1 is simplified, fragmentary, perspective view of a strapping machine constituting a preferred embodiment of this invention. An inlet conveyor, which is used to convey a compressible load into the strapping machine, is suggested by a series of parallel rollers.

As shown in the drawings, a strapping machine 10 constitutes a preferred embodiment of this invention. The strapping machine 10 is shown as used to compress a compressible load along a vertical axis, as well as along a longitudinal, horizontal axis, to confine the load along a transverse, horizontal axis while the load is compressed, and to strap the load with four parallel straps after the load has been compressed.

Figure 2:
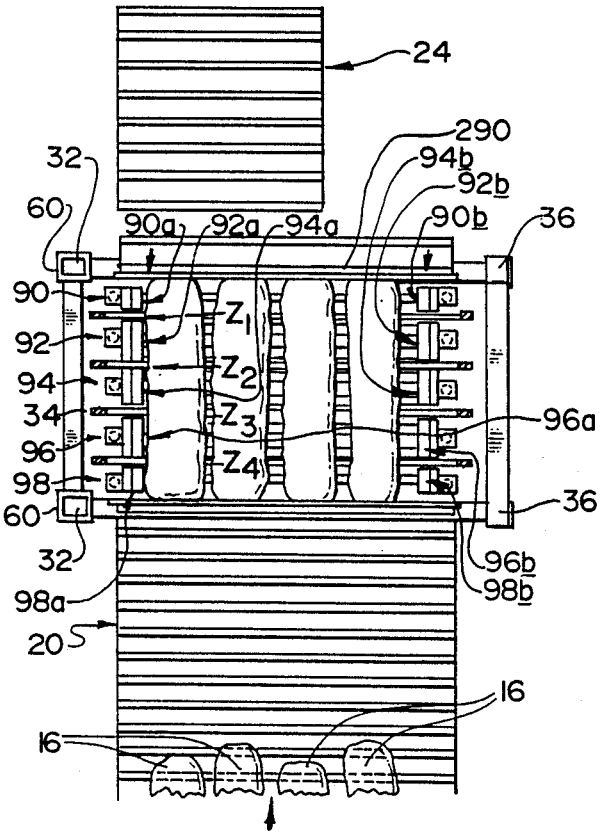
FIG. 2 is a reduced, simplified, fragmentary , top plan view, which shows four bags containing compressible batts of fiberglass insulation, constituting an exemplary load, and having been placed onto a table of the strapping machine. The inlet conveyor suggested in FIG. 1 is shown, on which four bags for a next load are shown fragmentarily, as well as an outlet conveyor, which is used to convey a strapped load from the machine. Upper portions of the strapping machine have been omitted so as to reveal lower portions of the strapping machine.
Figure 3:
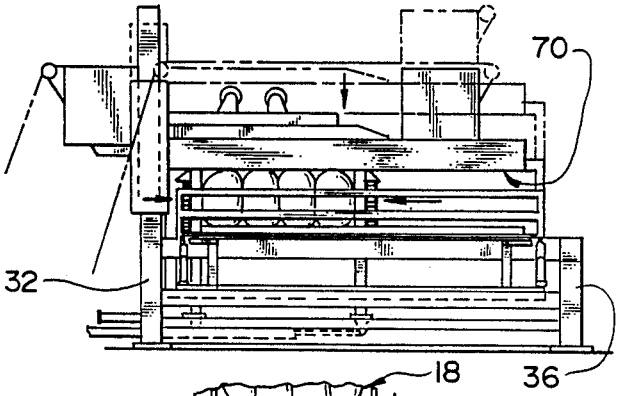
FIG. 3 is a similarly reduced, simplified, elevational view, which is taken from the lower right of the strapping machine as shown in FIG. 1. The exemplary load shown in FIG. 1 is shown as compressed along a vertical axis, as well as along a longitudinal, horizontal axis, i.e., endwise.
Figure 4:
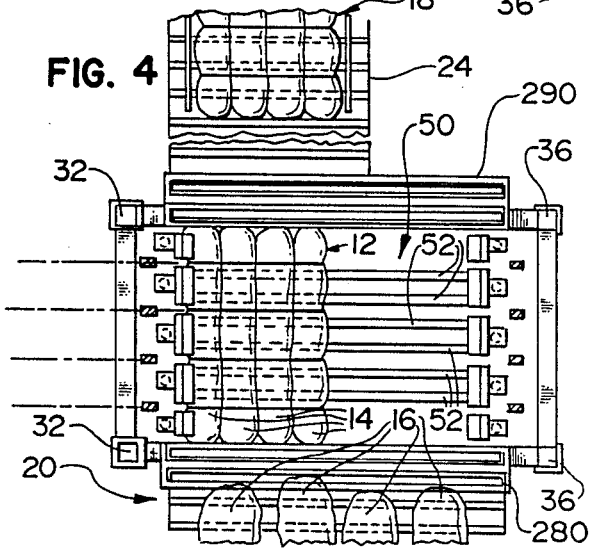
FIG. 4 is a view similar to FIG. 2 but taken after the exemplary load has been strapped with four parallel straps. A prior load, which has been strapped, is shown fragementarily on the outlet conveyor. Such bags for the next load are shown as having been advanced by the inlet conveyor.

In FIGS. 2, 3, and 4, an exemplary load 12 is shown which consists of four bags 14, each containing one or more batts of fiberglass insulation. Such bags 14 are conveyed into the strapping machine 10 in which such bags 14 are compressed, confined, and strapped, whereupon the exemplary load 12 is conveyed from the strapping machine 10. In FIGS. 2 and 4, four bags 16 are shown, for a later load like the exemplary load 12, as such bags 16 are conveyed toward the strapping machine 10. Such bags 16 are shown as farther from the strapping machine 10 in FIG. 3 and as closer to the strapping machine 10 in FIG. 4. In FIG. 4, a prior load 18 is shown, which is like the exemplary load 12, as the prior load 18 is conveyed away from the strapping machine 10. An inlet conveyor 20, which is used to convey the bags for each load toward and into the strapping machine 10, is suggested by a series of parallel rollers 22, which may be motor-driven. An outlet conveyor 24, which is used to convey each strapped load away from the strapping machine 10, is suggested by a series of parallel rollers 26, which also may be motor-driven. Precise details of the conveyors 20, 24, are outside the scope of this invention.

The strapping machine 10 comprises a main frame 30, which includes two taller stanchions 32, a cross-beam 34 connecting the taller stanchions 32, two shorter stanchions 36, a cross-beam 38 connecting the shorter stanchions 36, and various longitudinal elements connected between the taller stanchions 32 and the shorter stanchions 36. A roller table 50, which is supported by the frame 30, comprises a series of parallel rollers 52, which are journalled to the frame 50, and which are driven by a hydraulic motor (not shown) via a sprocket and chain drive (not shown) in a known manner. A plane defined by such rollers 52, which are tangent with the plane, is regarded as a load-supporting plane.

Each of the stanchions 32, 36, is square in outer cross-section. Two sleeves 60, which are square in inner cross-section, are provided. Each of the sleeves 60 is mounted around a respective one of the taller stanchions 32 for vertical movement of the sleeves 60 along such stanchions 32. Each of the sleeves 60 is guided by three upper rollers 62 and three lower rollers 64. The rollers 62, 64, which are carried by the sleeves 60, are arranged to roll along respective outer walls of the taller stanchions 32, as shown. A platen 70 is mounted integrally to the sleeves 60, via a cross-plate 72 connected integrally between the sleeves 60, so as to be thus cantilevered over the roller table 50. Because the sleeves 60 are mounted for vertical movement along the taller stanchions 32, the platen 70 is arranged for vertical movement, above the roller table 50, between an upper limit and a lower limit.

Hydraulically actuated means, as provided by a piston-cylinder mechanism 80, which has a cylinder 82 mounted to the cross-beam 34 and a piston (not shown) operating within the cylinder 82 and driving a piston rod 84 connected to the cross-plate 72, are actuatable selectively for elevating the platen 70 to its upper limit or for lowering the platen 70 toward its lower limit. The upper and lower limits of vertical movment of the platen 70 are defined by the stroke of the piston rod 84. It is contemplated by this invention that protoelectric or other limit switches (not shown) may be also provided, so as to enable the upper limit, the lower limit, or both such limits to be selectively varied. Whether the platen 70 reaches its lower limit when the platen 70 is lowered depends upon on such factors as compressibility of the load and initial height of the load. A plane defined by the platen 70, where the platen 70 engages a load when the platen 70 is lowered, is regarded as a load-compressing plane, which is parallel with the load-supporting plane noted above.

Five pairs of load-end formers are provided, namely three wide pairs spaced from one another by a strap-handling zone of a suitable width (which is sufficient to allow a strap, as mentioned above, to pass through such zone without interference) and two narrow pairs, each spaced form one of the wide pairs by a strap-handling zone of a similar width. Thus, as shown in FIGS. 2 and 3, such pairs of load-end formers are constituted by a first pair 90 of narrow load-end formers comprising a load end former 90*a*, which is closer to the cross-beam 34, and a load-end former 90*b*, which is closer to the cross-beam 38, a second pair 92 of wide load-end formers being spaced by a first strap-handling zone $Z_1$ from the first pair 90 and comprising a load-end former 92*a*, which is spaced equally from the load-end former 90*a*, and a load-end former 92*b*, which is spaced equally from the load-end former 90*a*, a third pair 94 of wide load-end formers being spaced by a second strap-handling zone $Z_2$ from the second pair 92 and comprising a load-end former 94*a*, which is spaced equally from the load-end former 92*a*, and a load-end former 94*b*, which is spaced equally from the load-end former 92*b*, a fourth pair 96 of wide load-end formers being spaced by a third strap-handling zone $Z_3$ from the third pair 94 and comprising a load-end former 96*a*, which is spaced equally from the load-end former 94*a*, and a load-end former 96*b*, which is spaced equally from the load-end former 94*b*, and a fifth pair 98 of narrow load-end formers being spaced by a fourth strap-handling zone $Z_4$ from the fourth pair 96 and comprising a load-end former 98*a*, which is spaced equally from the load-end former 96*a*, and a load-end former 98*b*, which is spaced equally from the load-end former 96*a*. As representative examples, the load-end formers 90*a*, 92*a*, 94*a*, 96*a*, 98*a* are shown in further detail in FIGS. 11 and 12.

As a representative example of the narrower load-end formers, the load-end former 98*a* is shown in FIGS. 5, 6, 11, and 12, as comprising an upper tube 100, which is square in outer cross-section, a lower tube 102, which is square in inner cross-section, and which is telescoped around the upper tube 100 for vertical movement of the upper tube 100 relative to the lower tube 102, an upper forming member 104, which is mounted to the upper tube 100 for conjoint movement with the upper tube 100 relative to the lower tube 102, a lower forming member 106, which is mounted to the lower tube 102, an upper forming blade 108, which is mounted to the upper forming member 104, so as to extend upwardly and inwardly over the roller table 50, a lower forming blade 110, which is mounted to the lower forming member 106, so as to extend downwardly and inwardly over the roller table 50, against which the lower forming blade 110 wipes when the load-end former 98a moves along the roller table 50, and means 112 for biasing the upper tube 100, the upper forming member 104, and the upper forming blade 108 upwardly, toward an extended condition of the load-end former 98a, but allowing the upper tube 100, the upper forming member 104, and the upper forming blade 108 to be forcibly lowered, toward a shortened condition of the load-end former 98a. The biasing means 112 comprise an upper flange 114, which is mounted rigidly to the upper tube 100, a lower flange 116, which is mounted rigidly to the lower tube 102, below the upper flange 114, a rod 118, which extends downwardly from the upper flange 100, through an aperture (not shown) in the lower flange 116, and which is threaded at its lower end (not shown) where a nut (not shown) is threaded thereon, and a coiled spring 124, which is piloted over the rod 118, between the upper flange 114 and the lower flange 116, and which biases the upper tube, via the upper flange 114, and the lower tube 102, via the lower flange 116, to the extended position of the load-end former 98a, as the extended position of the load-end former 98a is defined by engagement between the lower flange 116 and the nut threaded on the lower end of the rod 118. The shortened condition of the load-end former 98a is defined by relative lengths of the tubes 100, 102, and is achieved before the coiled spring 124 is compressed fully. The upper tube 100 is provided, at its upper end 126, with a pair of rollers 128 for a purpose to be later described.

As a representative example of the wider load-end formers, the load-end former 94a is shown in FIGS. 6 and 8 through 12 as comprising an upper tube 130, which is square in outer cross-section, a lower tube 132, which is squre in inner cross-section, and which is telescoped over the upper tube 130 for vertical movement of the upper tube 130 relative to the lower tube 132, an upper forming member 134, which is mounted to the upper tube 100 for conjoint movement with the upper tube 130 relative to the lower tube 132, a lower forming member 136, which is mounted to the lower tube 132, an upper forming blade 138, which is mounted to the upper forming member 134, so as to extend upwardly and inwardly over the roller table 50, and a lower forming blade 140, which is mounted to the lower forming member 136, so as to extend downwardly and inwardly over the roller table 50, against which the lower forming blade 140 wipes when the load-end former 94a moves along the roller table 50, and means 142 for biasing the upper tube 130, the upper forming member 134, and the upper forming blade 138 upwardly, toward an extended condition of thh load-end former 94a, but allowing the upper tube 130, the upper forming member 134, and the upper forming blade 138 to be forcibly lowered, toward a shorted condition of the load-end former 94a. The biasing means 142 comprise an upper flange 144, which is mounted rigidly to the upper tube 130, a lower flange 146, which is mounted rigidly to the lower tube 132, below the upper flange 144, a rod 148, which extends downwardly from the upper flange 130, through an aperture in the lower flange 146, in which is threaded at its lower end 150 where a nut 152 is threaded thereon, an a coiled spring 154, which is like the coiled spring 124, and which piloted over the rod 148, between the upper flange 144 and the lower flange 146, and which biases the upper tube 130, via the upper flange 144, and the lower tube 132, via the lower flange 146, to the extended position of the load-end former 96a, as the extended position of the load-end former 96a is defined by engagement between the lower flange 146 and the nut 152 threaded on the lower end 150 of the rod 148. The shortened condition of the load-end former 96a is defined by relative lengths of the tubes 130, 132, and is achieved before the coiled spring 154 is compressed fully. The upper tube 130 is provided, at its upper end 156, with a pair of rollers 158 for a purpose to be later described.

Figure 11:
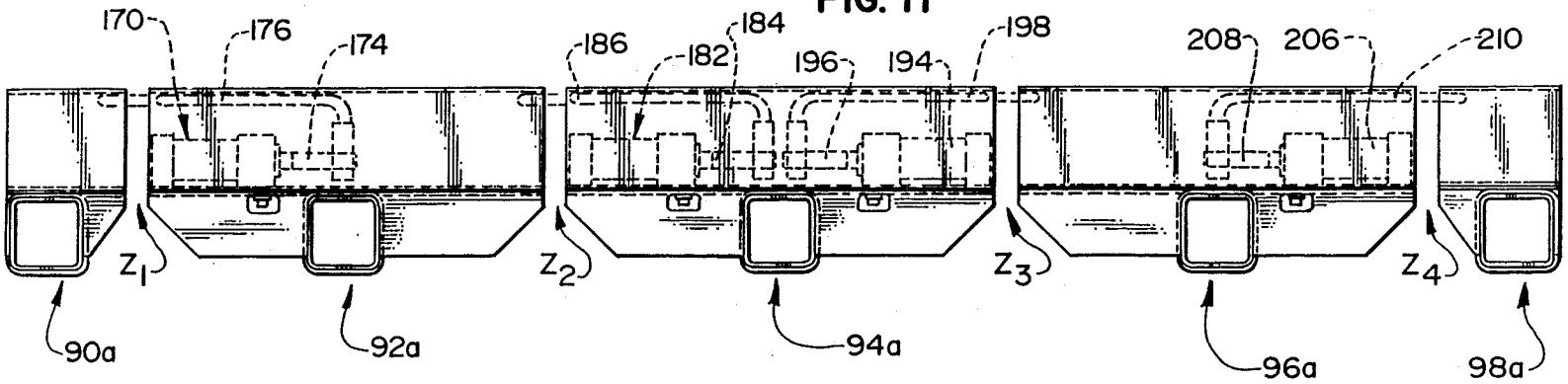
FIG. 11 is a similarly enlarged, fragmentary, top plan view of the load-end formers at one end of the strapping machine.
Figure 12:
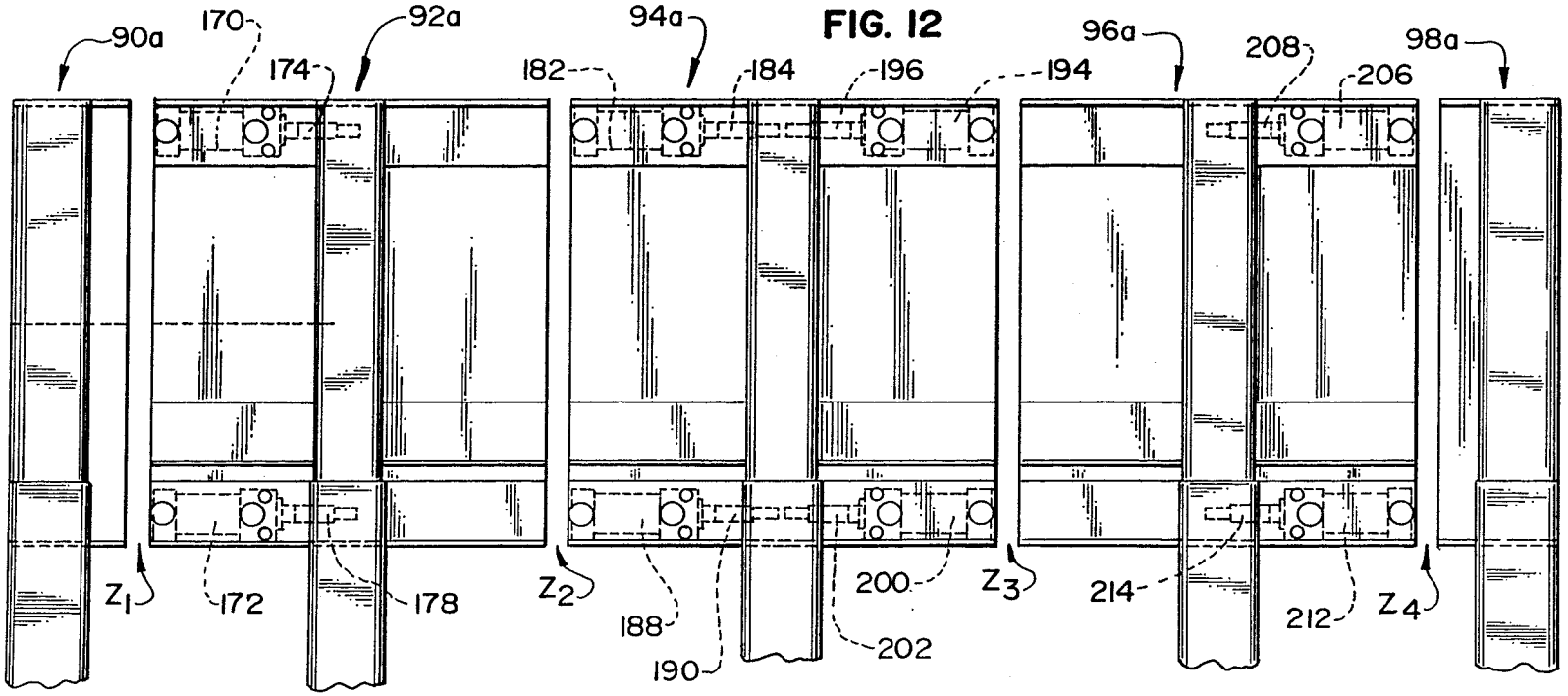
FIG. 12 is a similarly enlarged, fragmentary, elevational view of the load-end formers as shown in FIG. 11.

As shown in FIGS. 11 and 12, each of the load-end formers of the wide pairs 92, 94, 96, is provided (within a cavity defined by its upper forming member) with upper and lower, transversely oriented, hydraulically actuated, piston-cylinder mechanisms, each drivng a piston rod, which operates a transversely extending pin shiftable between an extended position and a withdrawn position. As a representative example, the load-end former 92a is provided with an upper, transversely oriented, hydraulically actuated, a piston-cylinder mechanism 170 and with a lower, transversely oriented, hydraulically actuated, piston-cylinder mechanism 172. The piston-cylinder mechanism 170 drives a piston rod 174, which operates a transversely extending pin 176 shiftable between an extended position and a withdrawn position. The pin 176 is shown in its withdrawn position in FIG. 11. In its extended position, which also is indicated (in phanton lines) in FIG. 11, the pin 176 bridges an upper portion of the first strap-handling zone $Z_1$, which is defined between the load-end formers 90 and the load-end formers 92. The piston-cylinder mechanism 172 drives a piston rod 178, which operates a transversely extending pin (not shown) similar to the pin 176 and shiftable between an extended position (in which such pin is spaced beneath the pin 176 and bridges a lower portion of the first strap-handling zone $Z_1$) and a withdrawn position. Similarly, the load-end former 94a is provided with an upper, transversely oriented, hydraulically actuated, piston-cylinder mechanism 182 driving a piston rod 184, which operates a similar pin 186, and with a lower, transversely oriented, hydraulically actuated, piston-cylinder mechanism 188 driving a piston rod 190, which similarly operates a similar pin (not shown) beneath the pin 186, such that the pin 186 and the pin operated by the piston rod 190 bridge upper and lower portions of the second strap-handling zone $Z_2$, which is defined between the load-end formers 92 and the load-end formers 94, when each such pin is in its extended position. Moreover, the load-end former 94a also is provided with an upper, transversely oriented, hydraulically actuated, piston-cylinder mechanism 194 driving a piston rod 196, which similarly operates a similar pin 198 opposite to the pin 176, and with a lower, transversely oriented, hydraulically actuated, piston-cylinder mechanism 200 driving a piston rod 202, which similarly operates a similar pin (not shown) beneath the pin 198, such that the pin 198 and the pin operated by the piston rod 202 bridge upper and lower portions of the third strap-handling zone $Z_3$, which is defined between the load-end formers 94 and the load-end formers 96, when each such pin is in its extended position. Furthermore, the load-end former 96a is provided with an upper, transversely oriented, hydraulically actuated, piston-cylinder mechanism 206 driving a piston rod 208, which operates a similar pin 210, and with a lower, transversely oriented, hydraulically actuated, piston-cylinder mechanism 212 driving a piston rod 214, which operates a similar pin (not shown) beneath the pin 210, such that the pin 210 and the pin operated by the piston rod 214 bridge upper and lower portions of the fourth strap-handling zone $Z_4$, which is defined between the load-end formers 96 and the load-end formers 98, when each such pin is in its extended position. Similar pins (not shown) operated similarly and associated with the load-end formers 92b, 94b, 96b, bridge upper and lower portions of the strap-handling zones $Z_1$, $Z_2$, $Z_3$, $Z_4$ when each such pin is in its extended position. The various pins bridging upper and lower portions of the strap-handling zones $Z_1$, $Z_2$, $Z_3$, $Z_4$, receive straps being applied by the strapping machine 10, as such straps are tensioned, severed, and joined, so as to prevent such straps from cutting into a compressible load, such as the exemplary load 12. After such pins are withdrawn, such a load rebounds slightly, until such joined straps become tight.

Figure 5:
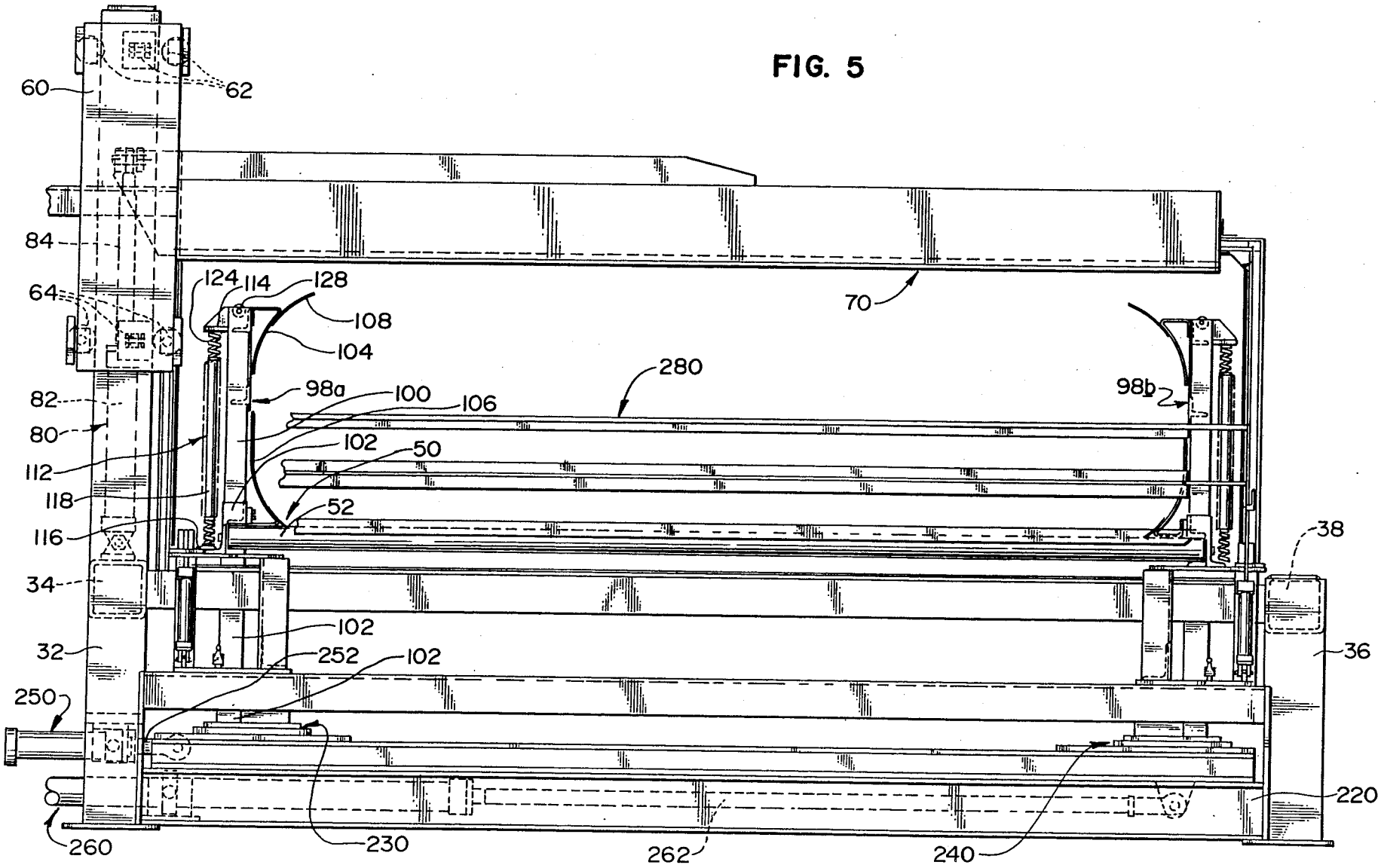
FIG. 5 is a greatly enlarged, more detailed but still somewhat simplified, fragementary, elevational view, which also is taken from the lower right of the strapping machine a shown in FIG. 1.
Figure 6:
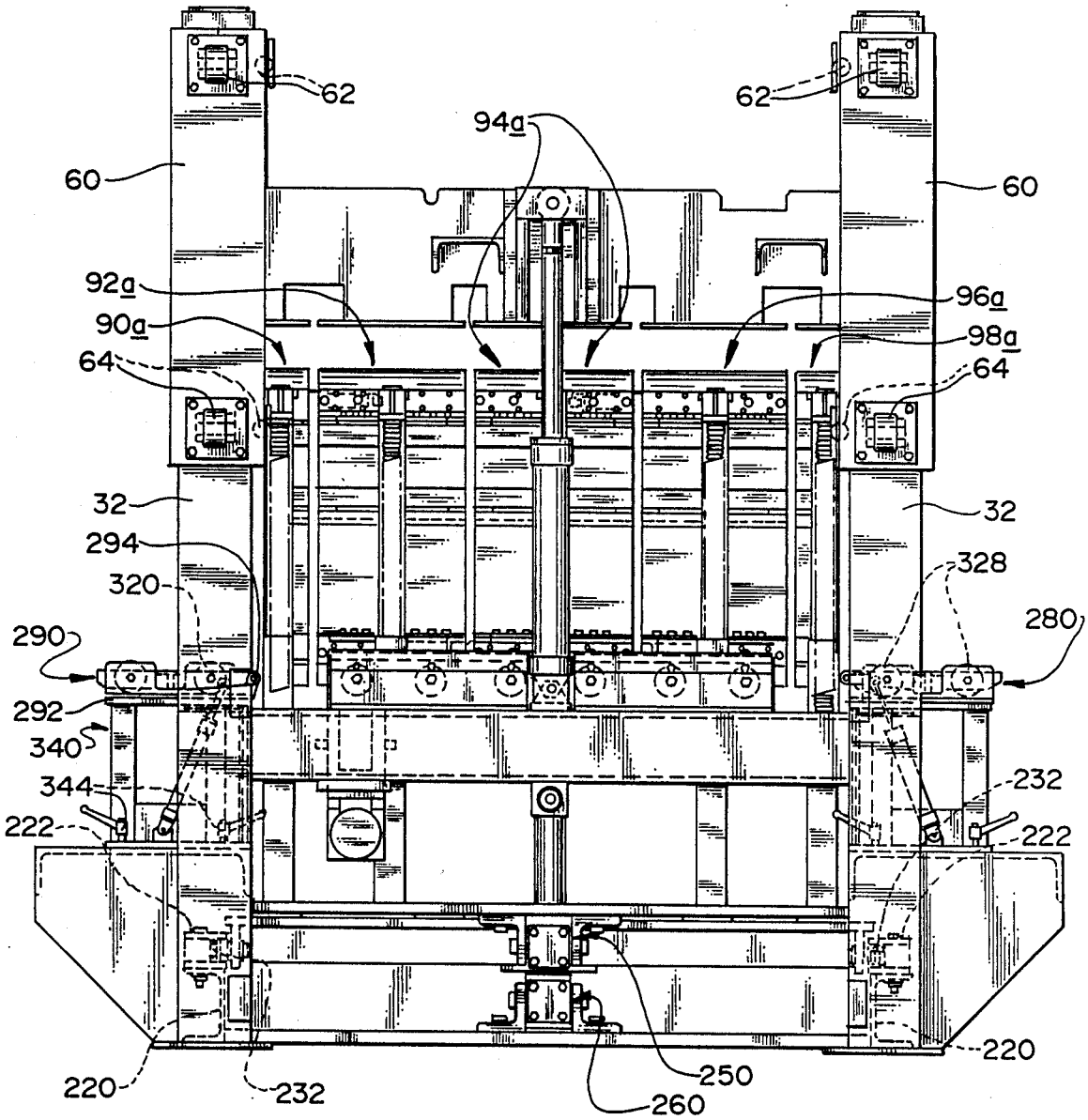
FIG. 6 is a similarly enlarged, elevation view, which is taken from the left end of the strapping machine as shown in FIG. 5.

Among other longitudinally extending elements of the main frame 30, two lower beams 220 are provided, as shown in FIGS. 5 and 6, each beam supporting 220 supporting a carriage rail 222 on one side of the strapping machine 10. A carriage 230 is provided, from which each of the lower tubes (e.g., the lower tubes 100, 130) of the load-end formers 90a, 92a, 94a, 96a, 98a, extends upwardly, for conjoint movement of such load-end formers with the carriage 230. The carriage 230 is guided by the carriage rails 222, via rollers 232 (see FIG. 6) journalled to each side of the carriage 230, for longitudinal movement of the carriage 230 along the cariage rails 222. A carriage 240 is provided, from which each of the lower tubes of the load-end formers 90b, 92b, 94b, 96b, 98b, extends upwardly, for conjoint movement of such load-end formers with the carriage 240. The carriage 240 is guided by the carriage rails 222, via rollers (not shown) similar to the rollers 232 and journalled to each side of the carriage 240, for longitudinal movement of the carriage 240 along the carriage rails 222.

A hydraulically actuated, short stroke, piston-cylinder mechanism 250 is provided, which drives a piston rod 252 linked mechanically to the carriage 230. Conjoint movement of the load-end formers 90a, 92a, 94a, 96a, 98a, toward and away from the load-end formers 90b, 92b, 94b, 96b, 98b, between a displaced condition (in which such load-end formers are displaced from where they are shown in FIGS. 1 and 5) in a normal position (in which they are shown in FIGS. 1 and 5) is limited, in either direction, by the stroke of the piston rod 222.

A hydraulically actuated, long stroke, piston-cylinder mechanism 260 is provided, which drives a piston rod 242 linked mechanically to the carriage 240. Conjoint movement of the load-end formers 90b, 92b, 94b, 96b, 98b, toward and away from the load-end formers 90a, 92a, 94a, 96a, 98a, between an operative condition (in which the load end formers 90b, 92b, 94b, 96b, 98b, are shown in FIG. 1) and in inoperative condition (in which they are shown in FIG. 5) is limited in either direction by the stroke of the piston rod 242. It is contemplated by this invention to provide photoelectric or other limit switches (not shown) or other conventional means (not shown) for adjusting the stroke of the piston rod 242.

When a load is to be compressed between the load-end formers of each pair, the load-end formers 90a, 92a, 94a, 96a, 98a, are held in the normal condition (in which they are shown in FIGS. 1 and 5) and the load-end formers 90b, 92b, 94b, 96b, 98b, are moved conjointly toward the load-end formers 90a, 92a, 94a, 96a, 98a, from the inoperative condition (in which the load-end formers 90b, 92b, 94b, 96b, 98b, are shown in FIG. 5) toward the operative condition (in which they are shown in FIG. 1) so as to compress the load between the load-end formers of each pair. Whether the load-end formers 90b, 92b, 94b, 96b, 98b, reach the operative condition depends upon such factors of compressibility of the load and initial length of the load.

After the compressed load has been strapped, the load-end formers 90b, 92b, 94b, 96b, 98b, are moved conjointly to the inoperative condition, as suggested in FIG. 4, whereupon the load-end formers 90a, 92a, 94a, 96a, 98a, are moved conjointly to the displaced condition, so as to displace the strap load, and then are moved conjointly to the normal condition, so as to withdraw the lower forming blades 110, etc., which might be otherwise pinched between the strap load and the roller table 50.

As shown in FIG. 6, a pair of load-confining doors are provided. Each such door is mounted pivotally to the main frame 30 for selective movement of such door between a vertical, closed position, which is suggested, for each such door, in FIG. 2, and a horizontal, opened position. In its vertical, closed position, each such door is disposed so as to confine one side of a load being compressed between the load-end formers of each pair. In its horizontal, opened position, each door is removed so as to permit a load to be placed onto or displaced from the roller table 50.

Thus, a load-confining door 280 comprising longitudinal panels (not shown) between end plates (not shown) is mounted pivotally to the main frame 30, at the inlet side of the strapping machine 10, for selective movement of such door 280 between a vertical, closed position (see FIG. 5) and a horizontal, opened position. Such door 280 is mounted pivotally to a shelf (not shown) fixed to the main frame 30, by hinges (not shown) at each end of such door 280, at one edge of such door 280, namely the edge constituting its lower edge when such door 280 is in its vertical, closed position.

Figure 14:
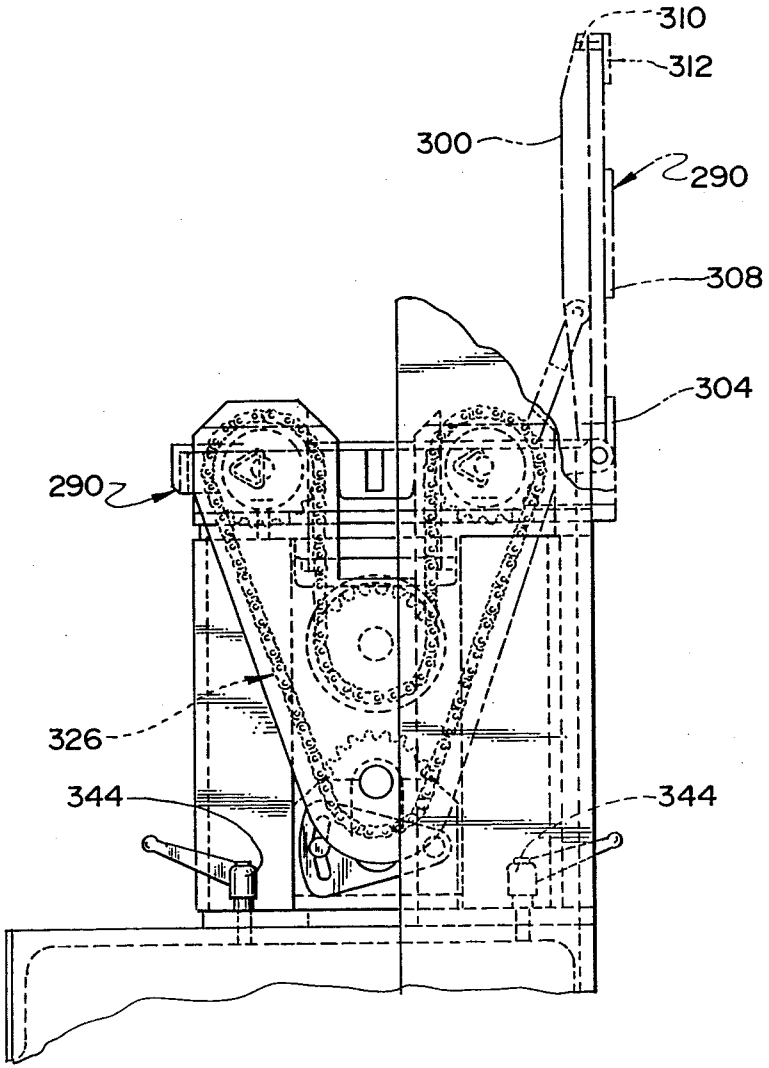
FIG. 14 is a similarly enlarged, fragmentary detail, which is taken from the right side of the load-confining door shown in FIG. 13. Certain elements are shown, in phantom lines, in changed positions.
Figure 13:
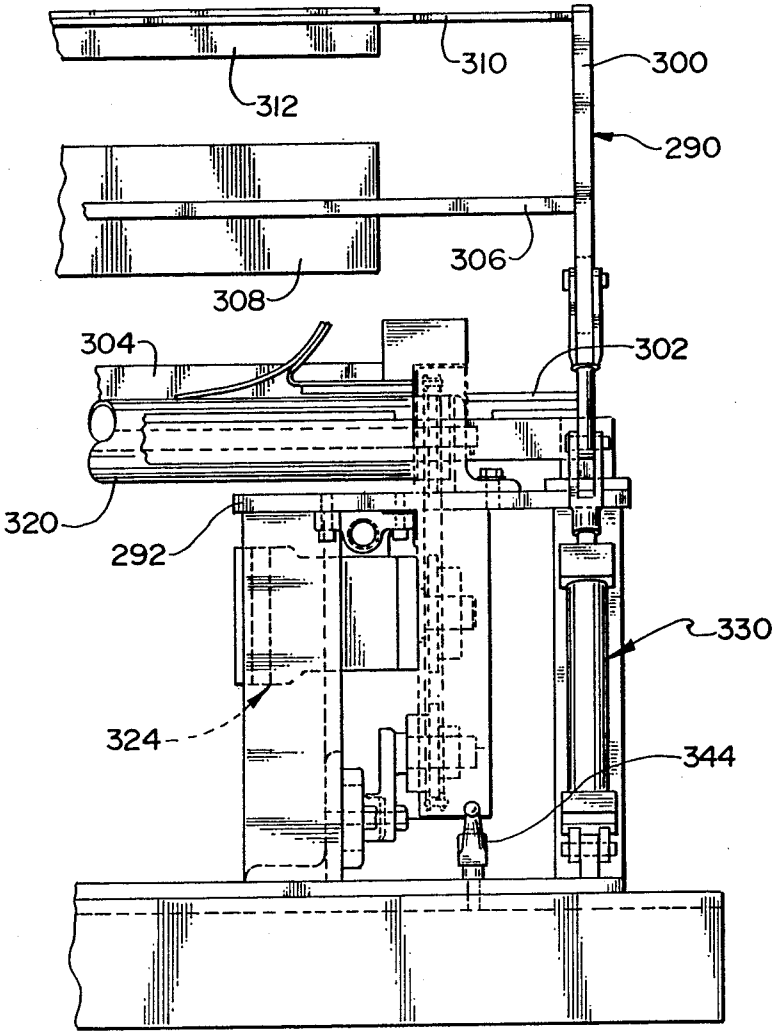
FIG. 13 is a similarly enlarged, fragmentary detail of a given end of a load-confining door of the strapping machine.
Figure 16:
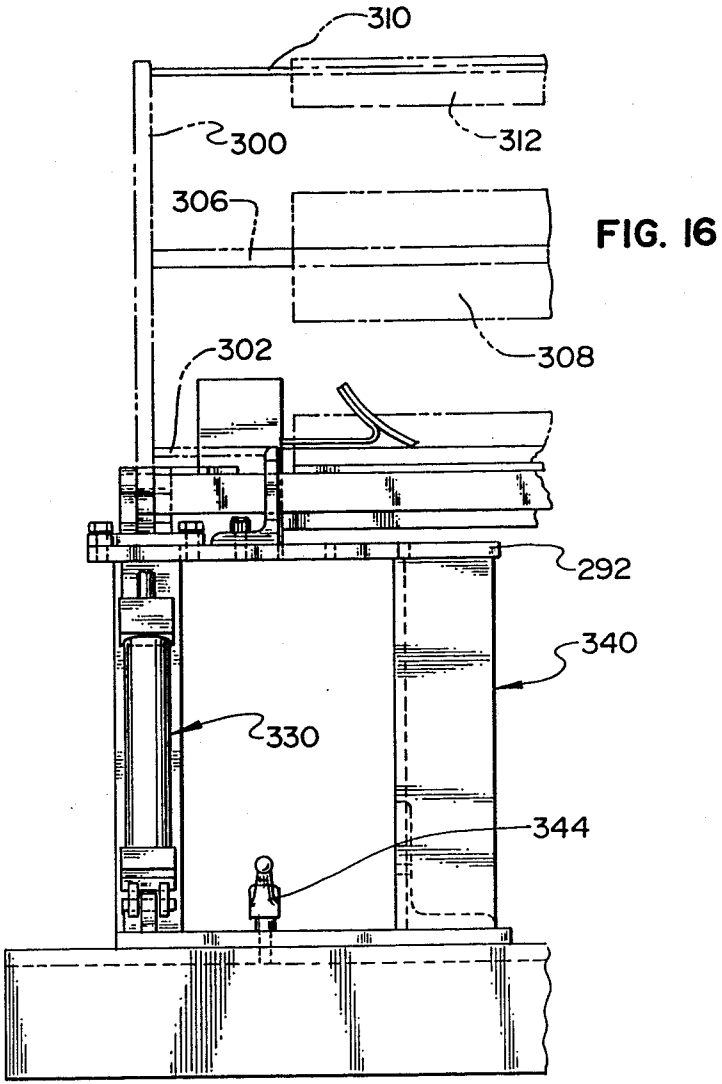
FIG. 16 is a view analogous to FIG. 13 but taken at the opposite end of the load-confining door.
Figure 15:
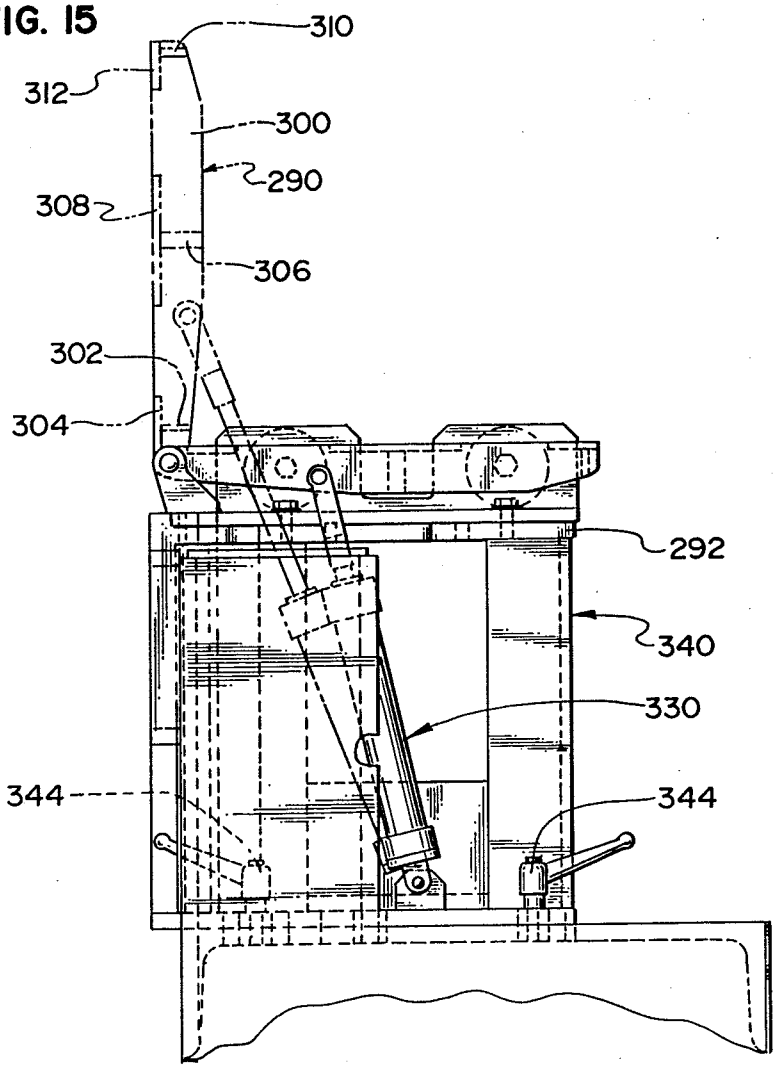
FIG. 15 is a view analogous to FIG. 14 but taken at the opposite end of the load-confining door.

Also, a load-confining door 290 is mounted pivotally to the main frame 230, at the outlet side of the strapping machine 10, for selective movement of such door 290 between the vertical, closed position, in which such door 290 is shown, in full lines, in FIG. 13, and in phantom lines, in FIGS. 14 through 16, and a horizontal, opened position, in which such door 290 is shown, in full lines, in FIGS. 13 through 16. Such door 290 is mounted pivotally to a shelf 292 fixed to the main frame 30, by hinges 294 at each end of such door 290, at one edge of such door 290, namely the edge constituting its lower edge when such door is in its vertical, closed position.

As a representative example of the load-confining doors 280, 290, which are similar to each other, the load-confining door 290 at the outlet side of the strapping machine 10 is shown in FIGS. 13 through 16 as comprising two end plates 300, which are mounted pivotally to the shelf 292 by the hinges 294, a cross-piece 302, which is mounted between the end plates 300, in close proximity to the hinges 294, a load-confining panel 304, which is mounted to the cross-piece 302 and spaced from the end plates 300, a cross-piece 306, which is mounted between the end plates 300 and spaced from the cross-piece 302, a load-confining panel 308, which is mounted to the cross-piece 308 and spaced from the end plates 300 and from the panel 304, a cross-piece 310, which is mounted between the end plates 300 and spaced from the cross-piece 306, and a load-confining panel 312 mounted to the cross-piece 310 and spaced from the end plates 300 and from the panel 308. The load-confining door 280 is constructed similarly.

Moreover, two parallel rollers 320 are jounalled to two end flanges 322, which are mounted to the shelf 292, so as to lie respectively between the panels 304, 308, and between the panels 308, 312, thereby to extend the roller bed 50 at the outlet side of the strapping machine 10, when such door 290 is in its horizontal, opened position. The rollers 320 are powered by the hydraulic motor 324 via a sprocket and chain drive 326, as shown in FIG. 14. Similarly driven rollers 328 (see FIGS. 2 through 4) are associated similarly with the load-confining door 280. Such rollers 328 extend the roller bed 50, at the inlet side of the strapping machine 10, when such door 280 is in its horizontal, opened position.

A hydraulically actuated, piston-cylinder mechanism 330 is provided at each end of the load-confining door 290. Such mechanisms 330 are arranged to be selectively and conjointly actuated for pivoting such door 290 to its vertical, closed position or to its horizontal, opened position. A hydraulically actuated, piston-cylinder mechanism 330 is provided at each end of the load-confining door 280. A similar mechanism 332 is provided at each end of the load-confining door 290. Such mechanisms 330, 332, are arranged to be selectively and conjointly actuated for pivoting each of such doors 290, 280, to its vertical, closed position or to its horizontal, opened position.

Furthermore, the shelf 292 constitutes an integral part of a sub-frame 340, which is arranged to be rigidly fastened (in a selective one of plural positions of adjustment) to a structural member 342 constituting an integral part of the main frame 30, via a plurality of handle-actuated bolts 344, as shown, whereby the door 290 is regarded as mounted pivotally to the main frame 230. The load-confining door 280 is mounted similarly to the main frame 230.

When the load-confining door 280 is pivoted to its horizontal, opened position, a load can then be conveyed from the inlet conveyor 20, onto the roller table 50, via the rollers 22 of the inlet conveyor 20, the rollers 328 associated with the load-confining door 280, and the rollers 52 of the roller table 50. When the load-confining door 290 is pivoted to its horizontal, opened position, a load can then be conveyed from the roller table 50, onto the outlet conveyor 24, via the rollers 52 of the roller table 50, the rollers 320 associated with the load-confining door 290, and the rollers 26 of the outlet conveyor 24. When each of such doors 280, 290, is in its vertical, closed position, such doors 280, 290, serve to align side surfaces (e.g., the bag ends, as shown) of a load placed onto the roller table 50 and to confine the load along a transverse, horizontal axis, between such doors 280, 290, while the load is compressed between the platen 70 and the roller table 50 and between the load-end formers of each pair noted above.

Figure 7:
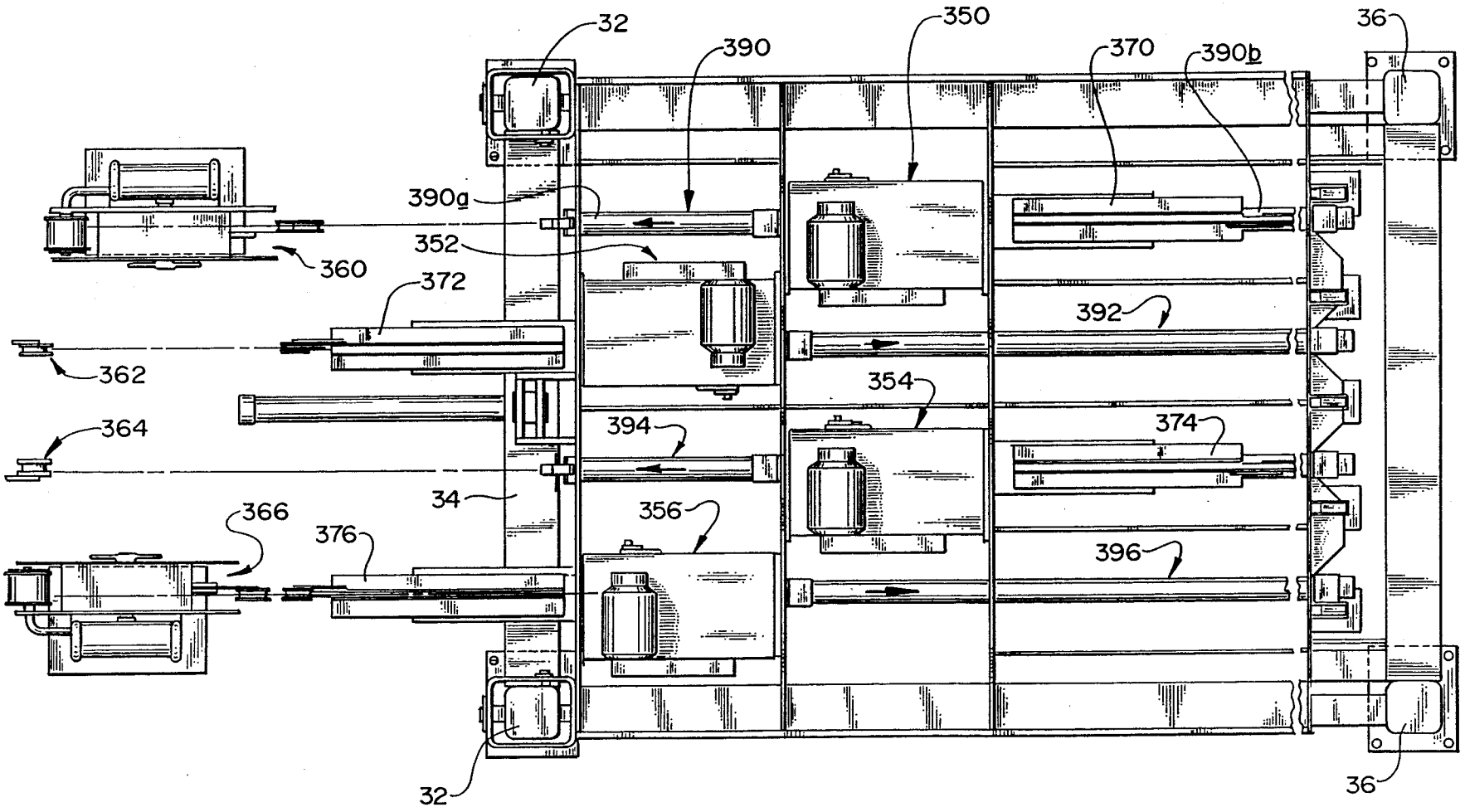
FIG. 7 is a similarly enlarged, fragmentary, top view of the strapping machine as shown in FIGS. 5 and 6.

As shown in FIG. 7, four similar strapping heads are carried by the platen 70, namely a first strapping head 350 associated with the first strap-handling zone $Z_1$, a second strapping head 352 associated with the second strap-handling zone $Z_2$, a third strapping head 354 associated with the third strap-handling zone $Z_3$, and a fourth strapping head 356 associated with the fourth strapping zone $Z_4$. Each strapping head is a Signode TM Model MCD-500 strapping head available commercially from Signode Corporation, Glenview, Ill., and designed to handle Tenax TM poly(ethylene terephthalate) strapping available commercially from Signode Corporation, supra, and to handle Contrax TM polypropylene strapping available commercially from Signode Corporation, supra. Each strapping head is arranged to feed a strap, (as supplied to such strapping head from a strap dispenser) through a strap chute, which guides the strap around a load and back to such strapping head, and to tension the strap, sever the strap, and join the strap by a friction weld into a tensioned loop. Because of spatial considerations, the first strapping head 350 and the third strapping head 354 are arranged to feed straps through the strap chutes associated therewith, in a counterclockwise sense, as viewed in FIG. 5, and the second strapping head 352 and the fourth strapping head 356 are arranged to feed straps through the strap chutes associated therewith, in a clockwise sense, as viewed in FIG. 5. Precise details of such strapping heads are outside of the scope of this invention.

As shown in FIG. 7, a first strap dispenser 360 is arranged to supply strapping (from which straps are to be thus severed) to the first strapping head 350. Moreover, a second strap dispenser 362, a third strap dispenser 364, and a fourth strap dispenser 366 are arranged to supply strapping respectively to the second strapping head 352, the third strapping head 354, and the fourth strapping head 356. Each of the strap dispensers 360, 362, 364, 366, is a Signode TM Model DF1-12D strap dispenser, as available commercially from Signode Corporation, supra. Pulleys are arranged, as shown, where needed to guide strapping from the respective strap dispensers to the respective strapping heads. Precise details of the such strap dispensers and associated pulleys are outside the scope of this invention.

Each of the strapping heads 350, 352, 354, 356, is arranged to receive a strap from the associated one of the strap dispensers 360, 362, 364, 366, to feed the strap through an associated strap chute described below, until the strap is fed back to the strapping head and to tension, sever, and join the strap with a friction weld, so as to form a tensioned loop. Signode TM Model MCD-500 strapping heads, as mentioned above, are arranged to sever the straps before joining them with friction welds.

Each of the strapping heads 350, 352, 354, 356, is provided with a strap accumulator of a known type, so as to accommodate any excess strap being pulled from the associated strap dispenser into the strapping head, namely a first strap accumulator 370, which is associated with the first strapping head 350, a second strap accumulator 372, which is associated with the second strapping head 352, a third strap accumulator 374, which is associated with the third strapping head 354, and a fourth strap accumulator 376, which is associated with the fourth strapping head 356. Precise details of the strap accumulators are outside the scope of this invention. Strap accumulators are used conventionally in strapping machines.

As shown in FIGS. 1 and 7, four strap chutes are carried by the platen 70, each coacting with a respective one of the strapping heads noted above, and each being arranged to guide a strap being fed by the strapping head coacting therebetween and to release the strap when the strap is tensioned by the same strapping head.

Each strap chute is aligned with a respective one of the strap-handling zones noted above.

Each strap chute includes two upper sections, two vertical sections, and a lower section, in a conventional arrangement for a strap chute. The upper sections are disposed above the load-compressing plane, as defined by the platen 70, and are spaced from each other so as to accommodate the strapping head coacting with such strap chute. The strapping head coacting with such strap chute is disposed between the upper sections. Each vertical section communicates at its upper end with a respective one of the upper sections, passes through the load-supporting plane, as defined by the roller table 50, and is adjacent to a respective end of the roller table 50. The lower section is disposed below the load-supporting plane, as defined by the roller table 50, at any elevation of the platen 70 between its upper and lower limits, and communicates at each of its opposite ends with the lower end of a respective one of the vertical sections. Except as disclosed herein, each strap chute conforms essentially to the strap chute disclosed in Urban et al. U.S. Pat. No. 4,520,720, the disclosure of which is incorporated herein by reference.

Thus, a first strap chute 390 is associated with the first strapping head 350 and is aligned with the first strap-handling zone $Z_1$, and a second strap chute 392 is associated with the second strapping head 352 and is aligned with the second strap-handling zone $Z_2$. Also, a third strap chute 394 is associated with the third strapping head 354 and is aligned with the third strap-handling zone $Z_3$, and a fourth strap chute 396 is associated with the fourth strapping head 356 and is aligned with the fourth strap-handling zone $Z_4$. The strap chutes 390, 392, 394, 396, are suggested in FIG. 1, are shown partially in FIG. 7, but are omitted in FIG. 6.

When four bags like the bags 14, for a load like the exemplary load 12, are placed onto the inlet conveyor 20, the load-confining door 280 on the inlet side of the strapping machine 10 is pivoted to its horizontal, opened position, whereby the rollers 328 associated with such door 280 extend the roller table 50 at the inlet side of the strapping machine 10, and the load-confining door 290 on the outlet side of the strapping machine 10 is pivoted to its vertical, closed position. Such bags can be then conveyed onto the roller table, via the rollers 22 of the inlet conveyor 20, the rollers 328 extending the roller table 50, and the rollers 52 of the roller table 50, until such bags reach the load-confining door 290, which aligns such bags and confines such bags at the outlet side of the strapping machine 10, whereupon the load-confining door 280 is pivoted to its vertical, closed position, whereby such door 280 confines such bags at the inlet side of the strapping machine 10. It does not matter if such bags happen to be thus compressed along a transverse, horizontal axis, as confined between the load-confining doors 280, 290.

After such bags have been confined between the load-confining doors 280, 290, the platen 70 is lowered, along with the strapping heads and associated strap chutes carried by the platen 70, whereby each load-end former is engaged by the platen 70, at the rollers at the upper end of the upper tube of such load-end former, so as to be forcibly telescoped from its extended condition toward its contracted condition, whereby such bags are confined between the platen 70 and the roller table 50, and whereby such bags can be also compressed along a vertical axis, between the platen 70 and the roller table 50. Whether the platen 70 reaches its lower limit depends upon such factors as compressibility of such bags and initial height of such bags. Thus, such bags are confined along a transverse, horizontal axis, between two load-confining planes defined respectively by the load-confining doors 280, 290, and along a vertical axis, between the load-compressing plane defined by the platen 70 and the load-supporting plane defined by the roller table 50. Also, as mentioned above, such bags can be vertically compressed, between the platen 70 and the roller table 50.

After such bags have been confined between the load-confining doors 280, 290, and between the platen 70 and the roller table 50, such bags can be endwise compressed along a longitudinal, horizontal axis, between the load-end formers of each pair, by conjoint movement of the load-end formers **90*b*, 92*b*, 94*b*, 96*b*, 98*b*, toward the load-end formers 90*a*, 92*a*, 94*a*, 96*a*, 98*a*, each of which is in the normal condition. Relative movement between the load-end formers and the platen 70 is facilitated by the rollers 128, 158, etc., as provided at the upper ends of the upper tubes of the load-end formers. Next, after the pins 176, 186, 198, 210, and similar pins noted above have been shifted, each to its extended position, such bags are strapped with four parallel straps, by the strapping heads 350, 352, 354, 356, which coact with the strap chutes 390, 392, 394, 396, whereupon each of such pins is shifted to its withdrawn position. Since the strap chutes 390, 392, 394, 396, are aligned respectively with the strap-handling zones $Z_1$, $Z_2$, $Z_3$, $Z_4$, such straps pass respectively through the strap-handling zones $Z_1$, $Z_2$, $Z_3$, $Z_4$, as such straps are tensioned by the strapping heads 350, 352, 354, 356**.

After such bags have been strapped, so as to form a strapped load, the load-end formers **90*b*, 92*b*, 94*b*, 96*b*, 98*b*, are moved conjointly away from the load-end formers 90*a*, 92*b*, 94*b*, 96*b*, 98*b*, which are moved conjointly from the normal condition to the displaced condition, then back to the normal condition, so as to separate the strapped load from the load-end formers 90*a*, 92*a*, 94*a*, 96*a*, 98*a*, while the strapped load remains confined as mentioned above. Next, the platen 70 is elevated, along with the strapping heads and associated strap chutes carried by the platen 70**, so as to clear the strapped load.

After the platen 70 has been elevated, so as to clear the strapped load, the load-confining door 290 at the outlet side of the strapping machine 10 is pivoted to its horizontal, opened position, whereby the rollers 320 associated with such door 290 extend the roller table 50 at the outlet side of the strapping machine 10, whereupon the strapped load can be then conveyed from the roller table 50, onto the outlet conveyor 24 via the rollers 52 of the roller table 50, the rollers 320 associated with such door 290, and the rollers 26 of the outlet conveyor 24. The load-confining door 280 at the inlet side of the strapping machine 10 may be simultaneously or subsequently pivoted to its horizontal, opened position. After the strapped load has cleared the rollers 320 associated with the load-confining door 290 at the outlet side of the strapping machine 10, such door 290 may be then pivoted to its vertical, closed position.

These and other operations of the strapping machine 10 may be advantageously controlled by a microprocessor, programmable controller, or other programmable means (not shown) which may be suitably programmed by a person skilled in the art.

Other enhancements and modifications may be also made in the strapping machine 10 without departing from the scope and spirit of this invention.

I claim:

1. In a strapping machine, which is arranged to compress a compressible load before strapping the load, a combination comprising:

(a) a frame;

(b) a table supported by the frame;

(c) a platen mounted to the frame, above the table, for vertical movement of the platen toward and away from the table, between an upper limit and a lower limit;

(d) means actuatable selectively for elevating the platen to the upper limit or for lowering the platen toward the lower limit;

(e) two load-end formers mounted between the table and the platen, in engagement with the platen at least after the platen has been lowered partially, and arranged for relative movement between the load-end formers and the platen and for relative movement of the load-end formers toward and away from each other, at any elevation of the platen between the upper and lower limits, even with the load-end formers in engagement with the platen; and (f) means actuatable selectively for imparting relative movement of the load-end formers toward each other, at any elevation of the platen between the upper and lower limits, or for imparting relative movement of the load-end formers away from each other, at any elevation of the platen between the upper and lower limits;

whereby if such a load is positioned onto the table, below the platen, between the load-end formers, the load can be endwise compressed along a longitudinal, horizontal axis, between the load-end formers, while the load is confined between the platen and the table, and whereby the load can be also compressed along a vertical axis, between the platen and the table.

2. The combination of claim 1 wherein the upper portion of each load-end former is provided with rollable means facilitating relative movement between such load-end former and the platen, upon relative movement of the load-end formers toward or away from each other, with the load-end formers in engagement with the platen.

3. The combination of claim 1 wherein each load-end former comprises upper and lower portions arranged for relative movement along a vertical axis, between an extended condition and a shortened condition, and means for biasing the upper and lower portions of such load-end former toward the extended condition, and wherein the platen is arranged to impart relative movement of the upper and lower portions of each load-end former from the extended conditions toward the shortened condition, as the platen is lowered with the load-end formers in engagement with the platen.

4. The combination of claim 3 wherein the upper portion of each load-end former is provided with rollable means facilitating relative movement between such load-end former and the platen upon relative movement of the load-end formers toward or away from each other.

5. The combination of claim 1 further comprising:

(g) a pair of load-confining doors, each load-confining door being mounted to the frame for selective movement between a closed position, in which such load-confining door is disposed so as to confine one side of such a load being compressed between the piston and the table or between the load-end formers, and an opened position, in which such load-confining door is removed so as to permit such a load to be positioned onto or displaced from the table;

whereby, when such a load is compressed, the load can be then confined between the load-confining doors.

6. The combination of claim 5 wherein each load-confining door is mounted pivotally to the frame at one edge constituting the lower edge of such load-confining door when such load-confining door is in the closed position of such load-confining door.

7. The combination of claim 6 further comprising:

(h) means actuatable selectively for pivoting each load-confining door to the closed position of such load-confining door or for pivoting such load-confining door to the opened position of such load-confining door.

8. The combination of claim 5 wherein each load-end former comprises upper and lower portions arranged for relative movement along a vertical axis, between an extended condition and a shortened condition, and means for biasing the upper and lower portions of such load-end former toward the extended condition, and wherein the platen is arranged to impart relative movement of the upper and lower portions of each load-end former from the extended condition, toward the shortened condition, as the platen is lowered with the load-end formers in engagement with the platen.

9. The combination of claim 8 wherein the upper portion of each load-end former is provided with rollable means facilitating relative movement between such load-end former and the platen upon relative movement of the load-end formers toward or away from each other, with the load-end formers in engagement with the platen.

10. In a strapping machine, which is arranged to compress a load before strapping the load, a combination comprising:

(a) a frame;

(b) a table supported by the frame;

(c) a platen mounted to the frame, above the table, for vertical movement of the platen toward and away from the table, between an upper limit and a lower limit;

(d) means actuable selectively for elevating the platen to the upper limit or for lowering the platen toward the lower limit;

(e) plural pairs of load-end formers, said pairs being spaced side-to-side from each other, each pair comprising two load-end formers mounted between the table and the platen, in engagement with the platen at least after the platen has been lowered partially, and arranged for relative movement between the load-end formers of such pair and the platen and for relative movement of the load-end formers of such pair toward and away from each other, at any elevation of the platen between the upper and lower limits, even with the load-end formers of each pair in engagement with the platen; and (f) means actuable selectively for imparting relative movement of the load-end formers of each pair toward each other, at any elevation of the platen between the upper and lower limits, or for imparting relative movement of the load-end formers of such pair away from each other, at any elevation of the platen between the upper and lower limits;

whereby if such a load is positioned onto the table, below the platen, between the load-end formers of each pair, the load can be endwise compressed along a longitudinal, horizontal axis, between the load-end formers of each pair, while the load is confined between the platen and the table, and whereby the load can be also compressed along a vertical axis, between the platen and the table.

11. The combination of claim 10 wherein the upper portion of each load-end former of each pair is provided with rollable means facilitating relative movement between such load-end former and the platen, upon relative movement of the load-end formers toward or away from each other, with the load-end formers in engagement with the platen.

12. The combination of claim 10 wherein each load-end former of each pair comprises upper and lower portions arranged for relative movement along a vertical axis, between an extended condition and a shortened condition, the upper portion of each load-end former of each pair being in engagement with the platen at least after the platen has been lowered partially, and means for biasing the uppeer and lower portions of such load-end former toward the extended condition, and wherein the platen is arranged to impart relative movement of the upper and lower portions of each load-end former from the extended condition, toward the shortened condition, as the platen is lowered with the load-end formers of each pair in engagement with the platen.

13. The combination of claim 12 wherein the upper portion of each load-end former is provided with rollable means racilitating relative movement between such load-end former and the platen, upon relative movement of the load-end formers toward or away from each other, with the load-end formers of each pair in engagement with the platen.

14. The combination of claim 10 further comprising:

(g) a pair of load-confining doors, each load-confining door being mounted to the frame for selective movement between a closed position, in which such load-confining door is disposed so as to confine one side of such a load being compressed between the piston and the table or between the load-end formers of each pair, and an opened position, in which such load-confining door is removed so as to permit such a load to be positioned onto or displaced from the table;

whereby, when such a load is compressed, the load can be then confined between the load-confining doors.

15. The combination of claim 14 wherein each load-confining door is mounted pivotally to the frame at one edge constituting the lower edge of such load-confining door when such load-confining door is in the closed position of such load-confining door.

16. The combination of claim 15 further comprising:

(h) means actuatable selectively for pivoting each load-confining door to the closed position of such load-confining door or for pivoting such load-confining door to the opened position of such load-confining door.

17. The combination of claim 14 wherein each load-end former of each pair comprises upper and lower portions arranged for relative movement along a vertical axis, between an extended condition and a shortened condition, the upper portion of each load-end former of each pair being in engagement with the platen at least after the platen has been lowered partially, and means for biasing the upper and lower portions of such load-end former toward the extended condition, and wherein the platen is arranged to impart relative movement of the upper and lower portions of each load-end former from the extended condition, toward the shortened condition, as the platen is lowered with the load-end formers of each pair in engagement with the platen.

18. The combination of claim 17 wherein the upper portion of each load-end former is provided with rollable means facilitating relative movement between such load-end former and the platen upon relative movement of the load-end formers of each pair toward or away from each other, with the load-end formers of each pair in engagement with the platen.

19. The combination of claim 10 wherein the platen defines a load-compressing plane, wherein the table defines a load-supporting plane and has two opposite ends, between which the load-end formers of each pair are movable, and further comprising:

(g) a strapping head carried by the platen, above the load-compressing plane, and arranged to feed a strap, tension the strap, sever the strap, and join the strap so as to form a tensioined loop; and (h) a strap chute carried by the platen, arranged to guide a strap being fed by the strapping head and to release the strap when the strap is tensioned by the strapping head, and aligned with a strap-handling zone defined between two adjacent pairs of the load-end formers, the strap chute including:

(1) two upper sections disposed above the load-compressing plane and spaced from each other so as to accommodate the strapping head, which is disposed between the upper sections;

(2) two vertical sections, each vertical section having an upper end and a lower end, communicating at the upper end with a respective one of the upper sections, passing through the load-supporting plane, and being adjacent to a respective one of the opposite ends of the table; and (3) a lower section disposed below the load-supporting plane, at any elevation of the platen carrying the strap chute between the upper and lower limits, the lower section having two opposite ends, each of the opposite ends of the lower section communicating with the lower end of a respective one of the vertical sections;

whereby, after such a load has been compressed between the load-end formers of each pair, the load can be then strapped via the strapping head coacting with the strap chute, by a strap passing through the strap-handling zone defined between the adjacent pairs of the load-end formers as the strap is tensioned by the strapping head.

20. The combination of claim 10 wherein the platen defines a load-compressing plane, wherein the table defines a load-supporting plane and has two opposite ends, between which the load-end formers of each pair are movable, and further comprising:

(g) plural strapping heads carried by the platen, above the load-compressing plane, each strapping head being arranged to feed a strap, tension the strap, sever the tensioned strap, and join the strap, so as to form a tensioned loop; and (h) plural strap chutes carried by the platen, each strap chute coacting with a respective one of the strapping heads, being arranged to guide a strap being fed by the coacting one of the strapping heads and to release the strap when the strap is tensioned by the coacting one of the strapping heads, being aligned with a strap-handling zone defined between two adjacent pairs of the load-end formers, and including:

(1) two upper sections disposed above the load-compressing plane and spaced from each other so as to accommodate the coacting one of the strapping heads, which one of the strapping heads is disposed between the upper sections;

(2) two vertical sections, each vertical section communicating with a respective one of the upper sections and passing through the load-supporting plane, and each vertical section being adjacent to a respective one of the opposite ends of the table; and (3) a lower section disposed below the load-supporting plane, at any elevation of the platen carrying the strap chute between the upper and lower limits, the lower section having two opposite ends, each communicating with a respective one of the vertical sections;

whereby, after such a load has been compressed between the load-end formers of each pair, the load can be strapped via the strapping heads coacting with the strap chutes, by straps passing through the strap-handling zones defined between the adjacent pairs of the load-end formers as the straps are tensioned by the strapping heads.

21. The combination of claim 20 wherein the platen has two opposite sides and wherein at least one of the strap chutes and the coacting one of the strapping heads are mounted to the platen so as to be adjustably positionable within a range of adjustment between the opposite sides of the platen.

* * * * *